United States Patent [19]

Gerlach et al.

[11] 3,974,320

[45] Aug. 10, 1976

[54] SYNTHETIC LEATHER PRODUCT AND METHOD OF PRODUCTION

[75] Inventors: Klaus Gerlach, Obernau; Hans Jürgen Pitowski, Miltenberg; Klaus Schneider, Erlenbach, all of Germany

[73] Assignee: Akzo N.V. of Arnhem, Holland, Wuppertal, Germany

[22] Filed: Aug. 6, 1973

[21] Appl. No.: 385,664

[30] Foreign Application Priority Data

Aug. 11, 1972 Germany ..... 2239541

[52] U.S. Cl. ..... 428/283; 427/289; 427/336; 427/412; 428/286; 428/288; 428/425; 428/904

[51] Int. Cl.[2] ..... D06N 3/14; B05D 1/38

[58] Field of Search ..... 117/76 T, 11, 135.5, 117/63, 76 FB; 161/89, 158, 170, 190, DIG. 2; 428/904, 283, 286, 288; 427/336, 289, 412

[56] References Cited

UNITED STATES PATENTS

| | | | |
|---|---|---|---|
| 3,238,055 | 3/1966 | Brightwell | 117/65.2 |
| 3,496,001 | 2/1970 | Minobe et al. | 117/11 |
| 3,503,784 | 3/1970 | Morita et al. | 117/76 T X |
| 3,555,129 | 1/1971 | Fukada et al. | 117/135.5 X |
| 3,745,041 | 7/1973 | Raymond | 428/904 X |
| 3,832,214 | 8/1974 | Wang | 117/63 X |
| 3,841,897 | 10/1974 | Okazaki et al. | 117/76 T |

*Primary Examiner*—Ralph Husack

*Attorney, Agent, or Firm*—Johnston, Keil, Thompson & Shurtleff

[57] ABSTRACT

A synthetic leather consisting essentially of three adherent microporous polyurethane layers, including a first base layer of a polyurethane impregnated fibrous fleece or web, a second or intermediate polyurethane layer containing 3–30% by weight of very finely divided insoluble solid particles with an individual volume is less than $2 \times 10^{-2}$ mm.$^3$ and with a maximum length generally below about 0.3 mm., preferably less than 0.1 mm., and a third or cover polyurethane layer which can be finished in a conventional manner. The product is especially distinguished by a smooth and uniform surface resistant to the "orange peel" effect. The method is distinguished by the application of the intermediate layer before the base layer is completely coagulated or solidified in the formation of the microporous structure.

15 Claims, No Drawings

SYNTHETIC LEATHER PRODUCT AND METHOD OF PRODUCTION

In the production of synthetic leathers, one attempts to achieve a structure and appearance resembling natural leather as closely as possible, including a fibrous substrate or base layer joined with a smooth cover or surface layer. The resulting synthetic or artificial leather material must exhibit good permeability to water vapor, a problem which has been substantially solved in this art by using a polyurethane impregnating and coating material in combination with a reinforcing fibrous web or fleece. The polyurethane is normally applied as a solution or gel which is then coagulated or solidified to form a microporous elastomeric polymer structure.

In addition to providing the essential microporous properties, one must also attempt to obtain good flexing behavior as well as softness and a smooth surface. A synthetic leather to be used as uppers or leg portions of shoes, boots or the like must completely avoid the orange peel effect if one is to have a commercially salable product. In general, it is thus understood that all surface unevenness and particularly this orange peel effect must be prevented, for example as caused by stretching the material in the manufacture of shoes or in the fitting of upholstery, especially at the toe of the shoe or along the edges of upholstered articles. The elimination of this problem would overcome one of the most serious prejudices against the use of synthetic leathers.

The known commercial synthetic or artificial leathers ordinarily consist of a textile base layer, especially a compressed fibrous web or fleece, which has been impregnated with an elastomeric bonding agent, and a microporous cover layer firmly adhered to this base layer. A polyurethane polymer is most commonly and preferably used both as the impregnating or bonding agent for the base layer and also for the production of the cover layer. The polyurethanes useful for this purpose are well known and are applied in the form of a solution or gel in an organic solvent which is then coagulated into a microporous elastomeric solid form by treatment with a suitable non-solvent and finally washed and dried. The elastomeric polyurethane impregnants and cover layers are well described in the literature, including U.S. Pat. Nos. 2,871,218 and 3,190,766 which also include blends of polyurethane with polyvinyl chloride.

Although the processes for producing a synthetic leather have been controlled to the extent that the end product exhibits a satisfactory moisture permeability and good flexing properties, difficulties still arise as before in the production of smooth outer surfaces which are especially important for synthetic leathers impressed with a fine grain appearance. Also, the problem caused by the so-called orange peel effect still has not been solved in a satisfactory manner.

It may be assumed that the orange peel effect is caused by variations in the thickness and physical properties of the fibrous base layer so as to yield a non-uniform or rough surface, especially when a shoe or other leather article is nipped or pinched and then stretched during its manufacture. Some experimentation has therefore been undertaken in attempt to improve the resistance to these undesirable effects, for example by application of a thicker surface layer or coating on the initial substrate. Indeed, one can achieve products in this manner which are distinquished by an improved surface smoothness, but this improvement is obtained only at the cost of causing substantially reduced flexibility and also a poorer leather-like handle or texture. Moreover, in retaining a constant thickness of the entire synthetic leather material, the proportion of the fibrous base layer must then be reduced so as to have a detrimental effect on the strength of the product. A number of difficulties also arise in the method required to produce such thicker surface coatings or cover layers, i.e. in their formation and application to the base layer.

Those synthetic leathers in which a fabric insert has been added between the fibrous base layer and the cover layer also exhibit a smoother outer surface and a reduction of the orange peel effect. However, the extensibility or elasticity of the product is influenced in an unfavorable manner by this fabric insert. This is particularly disadvantageous in footwear because shoes or the like produced from such a synthetic leather product do not adjust well to the foot of the wearer and are relatively stiff and uncomfortable for the wearer.

A synthetic or artificial leather is described in U.S. Pat. No. 3,510,344 wherein the disadvantages of surface roughness are to be avoided by a specific construction in which several polyurethane coating layers, each of a different "modulus", are built up on a needled fibrous base. The term modulus is defined in the patent as the slope of the load-extension curve at zero extension as measured on a film sample of 10 cm. by 2.5 cm. extended at a rate of 5 cm. per minute on an Instron Texter. In general, there must be about six superimposed layers which differ from each other in their composition and their modulus. For example, the concentration of the polyurethane may be varied and/or the polyurethane may be used in combination with another polymer and/or soluble or insoluble fillers may be incorporated in the individual layers. The improvement of the final properties of the synthetic leather product is achieved only by means of a very complicated coating procedure. Besides, it will be apparent that in producing a large number of coating layers of different composition, it becomes unusually difficult to guarantee a uniform quality over an extended period of production. Moreover, in coating three or more consecutive layers onto the substrate, each layer must be relatively thin and therefore difficult to apply or else the thickness of the entire coating becomes too large at the expense of the fibrous base layer.

A much less complex process is disclosed in U.S. Pat. No. 3,496,000 for the production of a three-layer artificial leather wherein the orange peel effect is likewise to be avoided. In this case, a fibrous base layer is treated such that two polymer solutions are applied one after the other, each solution containing solid particles of a removable filler, i.e. a water-soluble salt such as sodium chloride in a fine particle size range of about 7–25 microns. No other illustration is given of useful removable fillers, it being essential however to leach out such a filler so as to leave behind pores of about the same order of size (20 microns) as the usual microporous polyurethane structures. Although the process followed in this patent has the advantage of using simpler steps, it is also accompanied by considerable difficulties. The polyurethane is generally used as a solution in dimethyl formamide as the organic solvent and must be coagulated by treatment with water as a non-solvent. It will be apparent that the relatively expensive organic solvent must be recovered from the water. This turns out to be unusually difficult, however, if the mixture of water and organic solvent further contains a salt dissolved therein. Also, leaching of a water-soluble salt from a coagulated elastomeric layer presents certain problems of encapsulation and shrinkage which are not easily solved.

A smooth-surfaced synthetic leather product is also the object of U.S. Pat. No. 3,238,055 wherein a shoe-upper "poromeric" material is obtained which consists of two or possibly three distinct layers including a nonwoven fabric layer onto which there is superimposed and adhered a microporous vapor-permeable layer of a polyurethane elastomer containing staple fibers in a weight ratio of polymer: fiber of 80:20 to 97:3, i.e. a fiber-containing poromeric layer of the type in which the pores inter-communicate to permit the passage of water vapor. This second layer must have a density of at least 0.4g/cm.$^3$ which is achieved by means of a hot press applied under conditions sufficient to increase the density above the minimum critical value without at the same time destroying the necessary microporous vapor-permeable structure. The staple fibers include nylon, rayon, acetate, acrylic and polyester fibers in conventional staple lengths of about 2.5 to 10 mm. and a titer (size) of 0.8 to 6 denier. Shorter lengths of about 0.25 to 2.3 mm. of these same fibers may be used in exceptional cases. It is well known that the cutting of a filamentary yarn or tow into lengths of less than 1 mm. is rather difficult so that the introduction of extremely short staple fibers below this value has no practical significance within the teaching of the patent. Also, it is apparent that the length of the staple fibers should be decreased only at very high fiber concentrations with staple lengths above 2.5 mm. (i.e. higher than 0.1 inch) being considered to give the best results.

The procedure followed in U.S. Pat. No. 3,238,055 for the production of the two-layer product, i.e. an impregnated nonwoven fabric base combined with a fiber-containing layer, results in certain problems. The impregnated base layer must first be treated with a non-solvent to coagulate the polyurethan impregnant and this must be washed and dried to complete the development of the microporous structure of the base layer before applying the second fiber-containing polymer dispersion. This leads to a discontinuous transition point or interface between the two fibrous layers as can be seen from a photographic cross-section of the layered product. By comparison, a third fiber-free layer can be applied directly onto the second fiber-containing layer before coagulating, washing and drying this second layer, i.e. so that the development of can proceed simultaneously in both the second and third layers. This coagulation, washing and drying treatment is not used on all three layers at the same time. In order to achieve a really smooth surface, the patent notes that one must hot press the product whereby not only the surface or cover layer but also the layers therebelow must be compressed.

A careful study of the prior art has proven that surface unevenness and especially the orange peel effect is a serious problem for which no easy solution exists. Known processes dealing with the problem are either too complex and difficult to control or else the improvement in surface effect is accompanied by a distinct reduction in other desirable leather-like properties such as strength, flexibility, handle, etc. One cannot sacrifice these other properties merely in favor of improved surface characteristics.

It is an object of the present invention to provide a synthetic or artificial leather product which has very good properties in all respects, including a smooth surface which is resistant to the orange peel effect. Another object of the invention is to provide a simple and commercially feasible method of producing the desired product, especially one which requires only a relatively few steps and one which is easy to control over long periods of production.

In accordance with the invention, it has been found that one can achieve a highly improved synthetic leather product and method wherein there is essentially a conventional fiber-reinforced polyurethane base layer and a likewise conventional outer cover layer, the improvement being achieved by means of the incorporation of an intermediate polyurethane layer which contains about 3 to 30% by weight or about 10 to 20% by weight (with reference to the polyurethane content of the intermediate layer) of finely divided insoluble particles, preferably in the form of discrete and uniformly dispersed particles, with a volume of the individual particles of about $2\times10^{-2}$ to $0.5\times10^{-9}$ mm.$^3$ and preferably about $0.5\times10^{-3}$ to $2\times10^{-6}$ mm.$^3$ At least 85% of the particles must have a dimension in the direction of greatest particle length of not more than 0.3 mm.

This dimension of "greatest length" may also be identified as the "maximum length" of a given particle where there is an irregular shape of the particle. This dimension is preferably below about 0.1 mm. for all particles although some variation can be tolerated. Thus, the individual particles may consist of various organic and inorganic substances provided that these particles are insoluble in water and organic solvents so as to retain their solid characteristics in the finished product. Also, these solid particles may be present in any suitable configuration, e.g. in the approximate shape of spheres, cylinders, ellipsoids or completely irregular shapes.

The volume of the particles can be readily determined by known methods, it being especially suitable for example to use microscopic methods. The measurements can be accomplished directly under the microscope or can be made from microscopic photographs. If the particles generally exhibit a cylindrical form, as with fibrous particles, then the volume can be easily calculated from the measured length and diameter. With other shapes of particles which are not spherical or cylindrical but more irregular, one can draw a circle corresponding very closely to the microscopically visible surface of the particle and then use the diameter of this circle to calculate the volume of the sphere which closely approximates the volume of the irregular particle.

More detailed data on the determination of the volume of discrete particles, as used for purposes of the present invention, will be found for example in such references as "Lehrbuch der Chemischen Verfahrenstechnik", VEB Deutscher Verlag fur die Grundstoffindustrie, Leipzig (1967) or "Einfuehrung in die Korngroessenmesstechnik", by Wilhelm Batel, Springer-Verlag (1971). (1971).

In selecting very finely divided particles, it is not only the volume which is important but also the dimension of "greatest length" of the individual particles. In accordance with the invention, at least a minimum of 85% of the particles in the intermediate polyurethane layer must exhibit this "greatest" or "maximum" length of not more than 0.3 mm. Particles with a larger diameter when in approximately spherical form or with a larger length when in a cylindrical or highly irregular form may be separated by means of sieves, i.e. by a conventional screening. In a preferred form of the invention, all of these insoluble discrete particles of the intermediate layer are idetally below a greatest length value of about 0.1 mm.

The density of the discrete particles according to the invention preferably lie in a range of about 0.9 to 1.6 g/cm$^3$. These particles may consist of organic substances such as polyethylene, polypropylene, polyamide and polyesters as synthetic fiber-forming polymers or cellulose or closely related cellulosic derivatives which are also fiber-forming substances. It is especially suitable to employ a fiber dust, i.e. the fines composed of the solid particles obtained in the buffing or abrasion of the fiber-reinforced polyurethane base layer. This base layer is commonly produced with linear polyamide (nylon) or linear polyester (polyethylene terephthalate) types of fibers, and these or also cellulosic fibers are therefore easily obtained as a by-product from the buffing treatment of the impregnated and solidified base layer.

The buffing dust or fines contains polyurethane particles as well as the fibrous particles arising from the reinforcing web or fleece. These polyurethane particles, however, are substantially dissolved in the organic solvent such as dimethylformamide used for the application of the intermediate layer as a solution or gel of the polyurethane polymer. The combined abrasion or buffing dust-like fines taken from the base layer are especially favorably dispersed in the organic solvent so as to achieve an especially good distribution of the solid fibrous particles. Of course, care should be exercised to make certain that such buffing fines contain the required proportion of the fibrous solid particles in relationship to the total polyurethane content of the intermediate layer. A preliminary analysis of these fines can be carried out in a routine manner to ensure the correct proportion of insoluble solid particles in the intermediate layer.

Although one can usually employ the buffing dust or fines directly in the form as obtained in the buffing of the base layer, it is recommended in achieving the best results to subject these buffing fines or fibers extracted therefrom to grinding in order to substantially reduce their particle size, particularly the maximum length of these fibrous particles. After grinding this buffing dust or fines, fibrous particles with a maximum length of 0.3 mm. or more practically do not exist. Moreover, with this grinding treatment, the particles substantially lose their fibrous form so that all particles are less than 0.1 mm. and preferably less than 0.05 mm. in their dimensions of greatest particle length.

The use of substantially non-fibrous particles, i.e. particles which no longer have a fibrous form and do not exhibit the behavior of fibrous particles, is especially desirable because it becomes much simpler to handle the polyurethane dispersions of these particles when their maximum length is substantially reduced, e.g. so as to approximate the fiber diameter, preferably being not more than two or three times this diameter. Thus, in the pumping of such dispersions which contain typical staple fibers of substantial length, differences in fiber concentration always occur over the flow cross-section in conduits, pipes or the like, and this variation of concentration increases with increasing fiber length. For this reason, the use of the buffing dust and especially the further ground buffing dust or else the use of other particles of a non-fibrous shape is much preferred over an addition of staple fibers in formulating and using the polyurethane solution or gel.

Besides the dust or fines which are easily collected in buffing the impregnated fibrous fleece or web, one can of course also use other polymer particles such as those which accrue for example in various cutting processes, i.e. buffing, abrading, sawing or the like as applied to plastic material. Thus, any industrial process which yeilds fine insoluble particles of the type required therein may be utilized as a readily available and inexpensive source of these particles. Furthermore, particles with a density of more than 1.6 g/cm.$^3$ can be introduced into either the solvent or the non-solvent used in the production of the synthetic leather. Such higher density substances include for example various insoluble pulverulent inorganic substances such as barium sulfate, calcium carbonate, silicon dioxide and aluminum hydroxide. Water-soluble inorganic substances or those soluble in the organic solvents for polyurethanes must naturally be excluded as the finely divided particles of the present invention. This does not eliminate the use of soluble inorganic salts or the like for other purposes, e.g. as part of the aqueous coagulating bath.

In essence, the present invention permits a wide variety of both organic and inorganic particles, provided that they meet the individual volume and maximum length measurements and have the other specified essential properties. i.e. insolubility under the conditions of use in preparing the synthetic leather and preferably a capability of being uniformly dispersed in the initial polyurethane solution or gel to be applied as the intermediate layer.

The thickness of the intermediate and cover layers can be varied within certain reasonable limits. In general the thickness of these two applied layers taken together should amount to not more than about 30 to 40% of the entire thickness of all three layers of the synthetic leather product. At the same time, the thickness of the intermediate layer is preferably about 0.1 to 0.4 mm. The overall thickness of all the layers preferably corresponds as closely as possible to that of a natural leather.

The steps followed in producing the synthetic leather according to the invention are very direct and without undue complications. Thus, one proceeds by first impregnating the fibrous fleece or web of the base layer with a polyurethane solution or gel and then applying to this base layer, before there is a complete coagulation of the polyurethane, a second polyurethane solution or gel containing 3 to 30% by weight (with reference to the polyurethane content of the intermediate layer) of the required finely divided insoluble solid particles having the individual volume and maximum length as defined above. Thereafter the polyurethane material of the two layers thus joined is completely coagulated by treatment with a non-solvent for the polyurethane (i.e. water or a suitable aqueous solution), followed by washing and drying to complete the formation of a microporous structure in both layers. Finally, a polyurethane cover layer is applied onto the intermediate layer, preferably after first buffing the outer surface of the intermediate layer.

The intermediate layer can be applied directly to the impregnated base layer before any substantial coagulation of the polyurethane has occurred in the base layer. On the other hand, one can also partially coagulate the polyurethane of the base layer by treatment with the non-solvent for a period of time which is insufficient to cause complete coagulation, i.e. so that there is still substantial fluid mobility of the polyurethane gel or solution in the base layer, and only then apply the intermediate layer to the partially coagulated base layer. In either case, however, it is important to intimately join these two layers to each other so that there is a certain amount of diffusion of material at their transitional interface, i.e. an intimate blending of the polyurethane compositions of both of the layers. Only then are both layers completely coagulated, washed and dried, using a non-solvent in the usual manner for achieving a microporous structure.

In buffing the exposed undersurface of the base layer, one can easily accumulate the kind of buffing dust or ground fines which are highly suitable as particles to be uniformly distributed in the polyurethane intermediate layer. This represents a highly desirable reduction in cost with respect to the particles being used.

A light buffing or surface abrasion of the top or outer surface of the coagulated, washed and dried intermediate layer has two beneficial functions. In addition to providing a smoother and more uniform surface, this particular step makes certain that there is at least some surface exposure of the embedded solid particles which then come in contact with the subsequently applied cover layer. Again, there is thus ensured a strong adherence between these last two layers even though they are not coagulated in common.

The procedure of the present invention has been found to lead to better results than the known coating of the base layer which occurs only after the impregnated polyurethane of the base layer has been completely coagulated, washed and dried. In part, the application of the intermediate layer by the method of the present invention leads to a smoothing out or equalization of non-uniform characteristics of the base layer, especially the differences in thickness of this substrate which may ordinarily be almost imperceptible. The blending of materials at the transitional interface also contributes very substantially to the improvement in properties. A photographic cross-section of the final synthetic leather product shows that this transition between the layers is completely obscured, i.e. the product exhibits a generally continuous variation in density and other properties as one proceeds toward the outer surface of the cover layer. There is no perceptible separation line or transition point between the substrate or fibrous base layer, the intermediate particle-containing layer and the fiber-free outer layer in spite of the different compositions of these layers.

The polyurethane elastomeric materials used for the impregnation of the fibrous base layer and for the application of the intermediate and cover layers may be of the same or different types. One may use any of the well known polyurethane elastomers such as the conventional linear polyester- or polyetherurethanes which are soluble in an organic solvent such as dimethylformamide. All of the generally known polyurethanes and their minor variations or modifications are incorporated herein by reference to the specific patents and literature reference mentioned above as well as to many other reference sources in this art. It will be appreciated that these linear polymers are generally considered to be those having the requisite solubility in organic solvents while forming a microporous structure under treatment with water as a non-solvent. Likewise, the fibrous web or fleece used in the base layer can be prepared in accordance with conventional methods used in this art, preferably as a nonwoven web, sheet or felt of continuously laid fibers or filaments randomly positioned in a reasonably coherent and dense structure.

One can also adopt other well-known materials and practices in this art in the formation of the desired microporous reinforced polyurethane structure. For example, one can use many non-solvent solutions and other additives in the polyurethane solutions to cause them to gel and form an interconnected fine pore structure upon subsequent coagulation or solidification followed by washing and drying. Also, it is common for the polyurethane solutions or gels to have a concentration of about 15 to 30% by weight of the polyurethane in the solvent medium such as dimethyl sulfoxide, tetrahydrofuran, tetramethylurea, etc., as disclosed for example in U.S. Pat. No. 3,238,055. The use of dimethylformamide, i.e. N,N-dimethylformamide, is especially preferred as the most useful of the conventional solvents for polyurethane elastomers.

Other variations can be readily adopted from known practices in this art without departing from the spirit or scope of the invention.

The invention is further illustrated by the following individual examples. Percentages are by weight in all examples.

EXAMPLE 1

A fibrous fleece in the form of a non-woven web of synthetic fibers (polyethylene terephthalate) is impregnated with a polyurethane/dimethylformamide solution or gel in the usual manner, and this impregnated fleece is then conducted directly into a coagulating bath consisting of water with about 15% of dimethylformamide. After only a short retention time in this bath, the material which has only commenced its coagulation is provided with the second polyurethane layer by means of a doctor blade which is used to apply a paste-like layer of a thickness of approximately 1.0 mm.

This second or intermediate layer is thus a spreadable paste made from 18% polyurethane, 7.4% of buffing fines (as obtained in buffing the finished base layer), 7.4% of water and 67.7% of dimethylformamide. The buffing fines consist of about an equal number of polyurethane particles and fibrous particles. The paste for the intermediate layer correspondingly contains 16.8% (by weight) of the fibrous particles with reference to the total polyurethane. The individual finely divided fibrous particles have a volume of less than $0.6\times10^{-3}$ mm.$^3$ The polyurethane used in this case was produced by reaction of polyethylene adipate, i.e. the linear polyester having a molecular weight of about 2,000, with diphenylmethane-4,4'-diisocyanate in a molar ratio of 1:4.3, followed by chain extension with ethylene glycol. (See, for example, the explanation given for the preparation of urethane elastomers at pages 273 ff. of High Polymers, Vol. XVI, Polyurethans: Chemistry and Technology (Part I), by Saunders and Frisch, Interscience Publishers, John Wiley and Sons, New York, 1962).

After completion of the coagulation and washing of this two layer material, it is dried and then buffed smooth on both sides. Thereafter, the side represented by the second or intermediate layer is coated with a polyurethane cover layer having a thickness of about 1.2 mm., followed by a conventional coagulation, washing and drying. This third layer is a reaction product of polytetramethyleneglycol and diphenylmethane-4,4'-diisocyanate (molar ratio = 1:4), the chain being extended with ethylene glycol. The final surface is then embossed merely to impart a fine-grain appearance and finished in the usual manner.

The final product exhibits a total thickness of 2 mm., wherein the intermediate layer has a thickness of about 0.3 mm. while that of the cover layer is about 0.4 mm. This synthetic leather product exhibits no orange peel effect and has a completely smooth cover surface.

EXAMPLE 2

In the same manner as in Example 1, a synthetic leather is again produced but with the difference that there is applied an intermediate paste layer consisting of 21.7% of polyurethane, 3.7% calcium carbonate in the form of finely divided particles with a volume of the individual particles being from $0.5\times10^{-9}$ to $0.5\times10^{-6}$ mm.$^3$, 7.4% water and 67.2% dimethylformamide. The finished synthetic leather product exhibits no orange peel effect.

EXAMPLE 3

Another synthetic leather is produced in the same manner as in Example 1 except that the intermediate layer is applied as a paste consisting of 21.7% polyurethane, 3.7% finely divided aluminum hydroxide of an individual particle volume of $0.5\times10^{-9}$ to $0.5\times10^{-6}$ mm.$^3$, 7.4% water and 67.2% dimethylformamide. Again the finished leather product exhibits no orange peel effect.

EXAMPLE 4

A synthetic leather is produced as in Example 1 except that the intermediate layer is applied as a paste consisting of 21.7% polyurethane, 3.7% finely divided barium sulfate with an individual particle volume of about $5\times10^{-9}$ mm.$^3$, 7.4% water and 67.2% methylformamide. The finished synthetic leather product has a smooth cover surface and does not exhibit any orange peel effect.

EXAMPLE 5

Yet another synthetic leather is produced in the same manner as Example 1 with the exception that the intermediate layer is applied as a paste consisting of 21.7% polyurethane, 3.7% finely ground cellulose butyroacetate particles with a volume of the individual particles of about $0.5\times10^{-6}$ to $0.5\times10^{-5}$ mm.$^3$, 7.4% water and 67.2% dimethylformamide. A synthetic leather is obtained with a smooth surface exhibiting no orange peel effect.

All of the products of the foregoing examples exhibit good physical properties of strength, resistance to flexing and leather-like handle and surface texture as well as being very resistant to the orange peel effect. At the same time, the production of the synthetic leather is very easily carried out in relatively few steps and at comparatively low cost.

The invention is hereby claimed as follows:

1. A synthetic leather consisting essentially of three superimposed and adherent, microporous elastomeric layers:

a. a base layer consisting essentially of a fibrous fleece or web impregnated and bonded with a polyurethane bonding agent;

b. an outer polyurethane cover layer essentially free of fibers and solid particles; and c. an intermediate polyurethane layer lying between said fibrous base layer and said cover layer and containing 3 to 30% by weight, with reference to the polyurethane, of finely divided insoluble particles which have an individual volume of about $2\times10^{-2}$ to $0.5\times10^{-9}$mm$^3$., at least 85% of said particles exhibiting a dimension in the direction of greatest particle length of not more than 0.3 mm., said solid particles being distributed uniformly or gradually providing a continuous variation in density in proceeding from said base layer to said cover layer.

2. A synthetic leather as claimed in claim 1 wherein said particles have an individual volume of about $0.5\times10^{-3}$ to $2\times10^{-6}$ mm$^3$.

3. A synthetic leather as claimed in claim 1 wherein said particles have a density within a range of about 0.9 to 1.6 g/cm$^3$.

4. A synthetic leather as claimed in claim 1 wherein said intermediate layer contains about 10 to 20% by weight of said particles.

5. A synthetic leather as claimed in claim 1 wherein said particles consist of the fines obtained by buffing said elastomeric polyurethane bonded fibrous fleece or web base layer.

6. A synthetic leather as claimed in claim 5 wherein said particles consist essentially of finely ground buffing fines, substantially all of said particles exhibiting a dimension in the direction of greatest particle length of less than 0.1 mm.

7. A synthetic leather as claimed in claim 1 wherein the cover layer (b) and the intermediate layer (c) together constitute about 30 to 40% of the entire thickness of the product, the thickness of the intermediate layer (c) being about 0.1 to 0.4 mm.

8. A synthetic leather as claimed in claim 1 wherein the polyurethane material of the base layer (a) and the intermediate layer (c) are intimately blended into one another at their transitional interface.

9. A method for the production of a synthetic leather consisting essentially of a fiber-reinforced multi-layer microporous elastomer, which method comprises:

first impregnating a fibrous web or fleece with coagulatable composition consisting essentially of a polyurethane solution or gel to provide a base layer;

beginning the coagulation of the polyurethane in said base layer;

applying to said base layer, before the polyurethane is completely coagulated in said base layer, a second polyurethane solution or gel as an intermediate layer which contains uniformly dispersed therein about 3 to 30% by weight, with reference to the polyurethane, of finely divided insoluble solid particles with an individual volume of $2\times10^{-2}$ to $0.5\times10^{-9}$ mm$^3$., at least 85% of said particles exhibiting a dimension in the direction of greatest particle length of not more than 0.3 mm.;

thereafter completely coagulating the polyurethane of both said base layer and said intermediate layer by treatment with a non-solvent for the polyurethane, followed by washing and drying to complete the formation of a microporous structure in both layers; and finally applying a polyurethane cover layer substantially free of fibers and solid particles onto said intermediate layer.

10. A method as claimed in claim 9 wherein said intermediate layer is applied directly to said impregnated base layer before treatment with a non-solvent to cause said layers to coagulate.

11. A method as claimed in claim 9 wherein said impregnated base layer is treated with a non-solvent for a period of time which is insufficient to completely coagulate the polyurethane, then applying said intermediate layer of particle-containing polyurethane solution or gel onto the incompletely coagulated base layer.

12. A method as claimed in claim 9 wherein the outer surface of the coagulated, washed and dried intermediate layer is buffed before application of said cover layer.

13. A method as claimed in claim 9 wherein the particles of said intermediate layer are the fines produced by buffing the exposed surface of the completely coagulated, washed and dried base layer.

14. A method as claimed in claim 13 wherein said fines are ground to a maximum particle size of less than 0.1 mm. before their addition to the intermediate layer.

15. The product obtained by the method of claim 9.

* * * * *